US010866047B2

(12) United States Patent
Lied

(10) Patent No.: US 10,866,047 B2
(45) Date of Patent: Dec. 15, 2020

(54) GUN LOCK

(71) Applicant: Gun Lock, Skien (NO)

(72) Inventor: Kjersti Lied, Skien (NO)

(73) Assignee: GUNLOCK AS, Skien (NO)

( * ) Notice: Subject to any disclaimer, the term of this patent is extended or adjusted under 35 U.S.C. 154(b) by 0 days.

(21) Appl. No.: 16/295,104

(22) Filed: Mar. 7, 2019

(65) Prior Publication Data

US 2020/0271407 A1 Aug. 27, 2020

(51) Int. Cl.
*F41A 17/06* (2006.01)

(52) U.S. Cl.
CPC ..... *F41A 17/066* (2013.01)

(58) Field of Classification Search
CPC ..... F41A 17/06; F41A 17/066; F41A 17/063; F41A 17/46; F41A 17/54
USPC ..... 42/70.01, 70.06, 70.07, 7.11
See application file for complete search history.

(56) References Cited

U.S. PATENT DOCUMENTS 1,686,482 A * 10/1928 Windle ..... F41A 17/54 42/70.07
1,887,308 A * 11/1932 Jessup ..... F41A 17/54 42/70.06
2,893,152 A * 7/1959 Peluso ..... F41A 17/54 42/70.06
3,269,046 A * 8/1966 Schaefer ..... F41A 17/54 42/70.06
4,422,254 A * 12/1983 McQueen ..... F41A 17/56 42/70.05
4,467,545 A * 8/1984 Shaw, Jr. ..... G07C 9/00158 42/70.01
4,509,281 A * 4/1985 Dreiling ..... F41A 17/54 42/70.07
5,012,605 A * 5/1991 Nishioka ..... F41A 17/54 42/70.07
5,024,017 A * 6/1991 Nishioka ..... F41A 17/54 42/70.07
5,062,232 A * 11/1991 Eppler ..... F41A 17/063 42/70.11
5,075,994 A * 12/1991 Nishioka ..... F41A 17/54 42/70.07
5,392,552 A * 2/1995 McCarthy ..... F41A 17/54 42/70.06
5,416,472 A * 5/1995 Torii, Jr. ..... A47B 81/005 211/64
5,417,000 A * 5/1995 Chen ..... F41A 17/02 42/70.06
5,419,068 A * 5/1995 Pages ..... F41A 17/54 42/70.07

(Continued)

*Primary Examiner* — Jonathan C Weber
(74) *Attorney, Agent, or Firm* — Leydig Voit & Mayer, Ltd.

(57) ABSTRACT

A gun lock, for blocking the trigger of a gun, comprising a first and second armored part. The armored parts are locked to each other covering the trigger and is connected to a power source and contains switching means for switching between a locked and an unlocked state. Furthermore a biometric sensor and a processor are positioned inside one of the armored parts for processing the data from the biometric sensor and allowing unlocking if the data match data from allowed users. The locking beam and the at least one support beam is configured to be positioned on either side of the trigger inside the trigger guard when in a locked state. The two armored parts covers at least the trigger and trigger guard.

10 Claims, 4 Drawing Sheets

(56) References Cited

U.S. PATENT DOCUMENTS 5,487,234 A * 1/1996 Dragon ..... F41A 17/06 340/571
5,502,915 A * 4/1996 Mendelsohn ..... F41A 17/066 42/70.11
5,561,935 A * 10/1996 McCarthy ..... F41A 17/54 42/70.07
5,603,179 A * 2/1997 Adams ..... F41A 17/066 42/70.06
5,704,151 A * 1/1998 West ..... F41A 17/06 42/70.07
5,832,647 A * 11/1998 Ling ..... F41A 17/04 42/70.07
5,937,557 A * 8/1999 Bowker ..... F41A 17/066 102/472
6,098,330 A * 8/2000 Schmitt ..... F41A 17/066 382/145
6,154,995 A * 12/2000 Lenoir ..... F41A 17/06 42/70.07
6,253,480 B1 * 7/2001 Florez ..... F41A 17/06 42/70.06
6,260,300 B1 * 7/2001 Klebes ..... F41A 17/066 206/317
6,282,829 B1 * 9/2001 Mossberg ..... F41A 17/063 42/70.04
6,286,240 B1 * 9/2001 Collins ..... F41A 17/066 42/1.01
6,293,039 B1 * 9/2001 Fuchs ..... F41A 17/04 42/70.04
6,339,892 B1 * 1/2002 Ramos ..... F41A 17/02 42/70.06
6,343,140 B1 * 1/2002 Brooks ..... F41A 17/066 348/156
6,389,726 B1 * 5/2002 Bentley ..... F41A 17/54 42/70.06
6,408,555 B1 * 6/2002 Sapia ..... F41A 17/06 42/70.07
6,474,011 B1 * 11/2002 Sato ..... F41A 17/02 42/70.08
6,499,243 B1 * 12/2002 Herzog ..... F41A 17/066 42/70.06
6,843,014 B1 * 1/2005 Aponte ..... F41A 17/06 42/70.06
6,874,265 B1 * 4/2005 Pathak ..... F41A 17/066 42/70.06
6,925,742 B1 * 8/2005 Van Zyl ..... F41A 17/063 42/1.01
7,584,566 B2 * 9/2009 Victor ..... F41A 17/02 42/70.06
7,730,750 B2 * 6/2010 Victor ..... E05B 73/00 211/64
8,037,632 B2 * 10/2011 Pikielny ..... F41A 17/066 42/70.06
8,713,836 B1 * 5/2014 Haq ..... F41A 17/46 42/70.06
8,991,087 B2 * 3/2015 Ruffin ..... F41A 17/066 42/70.06
9,097,479 B1 * 8/2015 Barido ..... F41A 17/066
9,243,858 B1 * 1/2016 Stiles ..... F41A 17/066
9,404,699 B1 * 8/2016 Barido ..... F41A 17/54
9,970,725 B2 * 5/2018 Kiyani ..... F41A 17/063
10,190,837 B1 * 1/2019 Vafadar ..... F41A 17/54
2002/0157296 A1 * 10/2002 Vivian ..... F41A 17/066 42/70.11
2004/0216349 A1 * 11/2004 Riebling ..... F41A 17/54 42/70.07
2008/0134556 A1 * 6/2008 Remelin ..... F41A 17/066 42/70.07
2009/0007476 A1 * 1/2009 Mauch ..... F41A 17/063 42/1.01
2010/0107465 A1 * 5/2010 Pintar ..... F41A 17/02 42/70.07
2011/0047849 A1 * 3/2011 Brenner ..... F41A 17/54 42/70.07
2012/0011756 A1 * 1/2012 Albano Do Amarante ..... F41A 17/066 42/1.01
2012/0137559 A1 * 6/2012 Burns, III ..... F41A 17/54 42/70.06
2012/0291327 A1 * 11/2012 Boutot, Jr. ..... F41C 33/0263 42/70.11
2013/0312306 A1 * 11/2013 Ruffin ..... F41A 17/066 42/70.07
2014/0182180 A1 * 7/2014 Murphy, II ..... F41A 17/06 42/70.07
2014/0230300 A1 * 8/2014 Haq ..... F41A 17/54 42/70.06
2015/0204628 A1 * 7/2015 Wurkner ..... F41A 17/02 42/70.06
2016/0054083 A1 * 2/2016 Kiyani ..... F41A 17/063 42/70.11
2016/0377362 A1 * 12/2016 Farr ..... F41A 17/04 42/70.06
2017/0191775 A1 * 7/2017 Bibee ..... F41A 17/54
2018/0356172 A1 * 12/2018 Mack ..... F41A 17/54
2019/0212086 A1 * 7/2019 Shiner ..... F41A 17/54

* cited by examiner

GUN LOCK

CROSS-REFERENCE TO RELATED APPLICATIONS

This patent application claims the benefit under 35 USC 119 of Norwegian Patent Application No. 20190280, filed Feb. 27, 2019 which is incorporated by reference.

TECHNICAL FIELD

The present invention relates to a gun lock. More precisely to a gun lock comprising at least two parts blocking the trigger and wherein the locking mechanism is controlled by biometric input, preferably a fingerprint sensor.

BACKGROUND OF THE INVENTION

When a gun is not in use, like e.g. when it is stowed away safely, it should be locked. The lock should be easy to use and safe. The technology of biometric sensors has lately become cheap, small and easy to use. Therefore the use of such biometric sensors can be incorporated into new areas of use and gun locks is one of these areas. However there are problems with present day solutions. One of these solutions is a complicated lock system comprising a lock with two sides and controlled by a biometric sensor. These solutions are usually large, heavy and bulky and the control mechanism of the locking mechanism is quite complicated.

The use of a biometric sensor in a gun lock makes the fire arm personal. It is no longer possible to simply hand over a key or code to unlock the fire arm. The owner of the fire arm with a gun lock according to the invention must be present and extra safety is achieved.

SUMMARY OF INVENTION

The invention describes a gun lock, for blocking the trigger inside a trigger guard of a gun. The gun lock comprises a first armored part with a first abutting side from which a locking beam with a first locking formation is protruding, and a second armored part with a second abutting side comprising a second locking formation mating with the first locking formation. The first and second locking formations are switchable between a locked and unlocked state. The gun lock further comprises at least one support beam protruding from one of the abutting sides and extending at least past the trigger towards the other abutting side, a power source, and switching means positioned inside one of the armored parts for switching between the locked and unlocked state. Furthermore the gun lock comprises a biometric sensor reading biometric data of a user, a processor positioned inside one of the armored parts for processing the data from the biometric sensor and allowing unlocking if the data match data from allowed users. The locking beam and the at least one support beam is configured to be positioned on either side of the trigger inside the trigger guard when in a locked state, and wherein the two armored parts covers at least the trigger and trigger guard.

BRIEF DESCRIPTION OF FIGURES

In order to improve understanding of the invention a number of exemplary embodiments are shown in the figures. Same number refers to the same feature in different figures.

DETAILED DESCRIPTION

Figure 1:
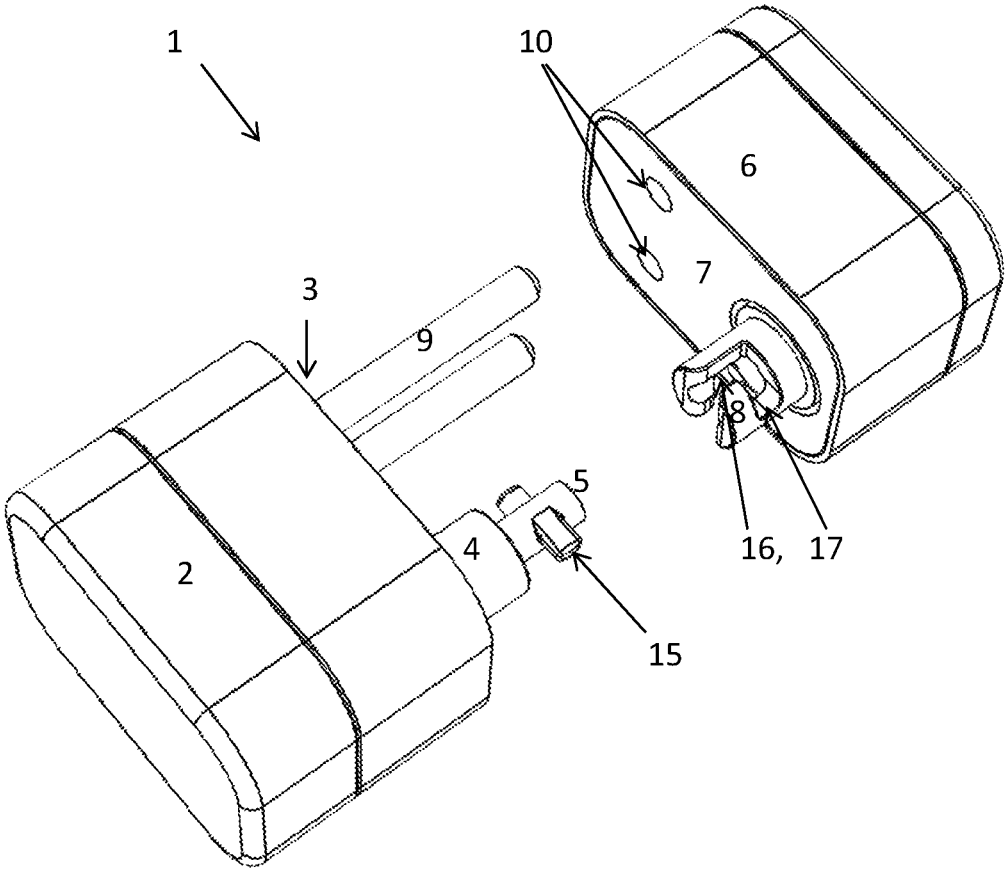
FIG. 1 shows an embodiment of the two armored parts for covering the trigger.

The invention describes a gun lock 1, for blocking the trigger inside a trigger guard of a gun. As shown in FIG. 1 the gun lock 1 comprises a first and second armored part 2, 6 which can be locked together covering the trigger and trigger guard and functions as a casing for mechanics and data processors 13 needed for the gun lock to function. The first armored part has a first abutting side 3 from which a locking beam 4 with a first locking formation 5 is protruding, and the second armored 6 part has a second abutting side 7 comprising a second locking formation 8 mating with the first locking formation 5. The mechanics is basically switching means 12 for switching between a locked and unlocked state.

The switching means 12 and processor 13 must reside within the armored parts. For practical reasons they are preferably positioned in the same armored part. The important feature is that the processor 13 and switching means 12 are protected from aggressors. The power source 11 and a biometric sensor unit 14 may be positioned on the outside of the armored parts because tampering with those will only lead to failures that will cause the gun lock to remain locked. For this to function it is important that at least most of the processing of biometric data from the biometric sensor 14 is done in the processor 13 inside the armored parts.

The gun lock further comprises at least one support beam(s) 9 protruding from one of the abutting sides extending at least past the trigger towards the other abutting side. The support beams may also mate with corresponding holes 10 in the other abutting side. The first and second locking formation 5, 8 is switchable between a locked and unlocked state. In one embodiment the first locking formation 5 is at least one locking pin 15 protruding at a right angle from a cylindrical outer part of the locking beam and the second locking formation is a pipe with a longitudinal guiding track(s) 16 mating with the cylindrical outer part and the pin(s) 15, and a locking track 17 at a right angle to the guiding track(s). In this embodiment a rotational movement of the first or second locking formation will lock the two parts together, resisting movement of the two armored parts away from each other.

Figure 2:
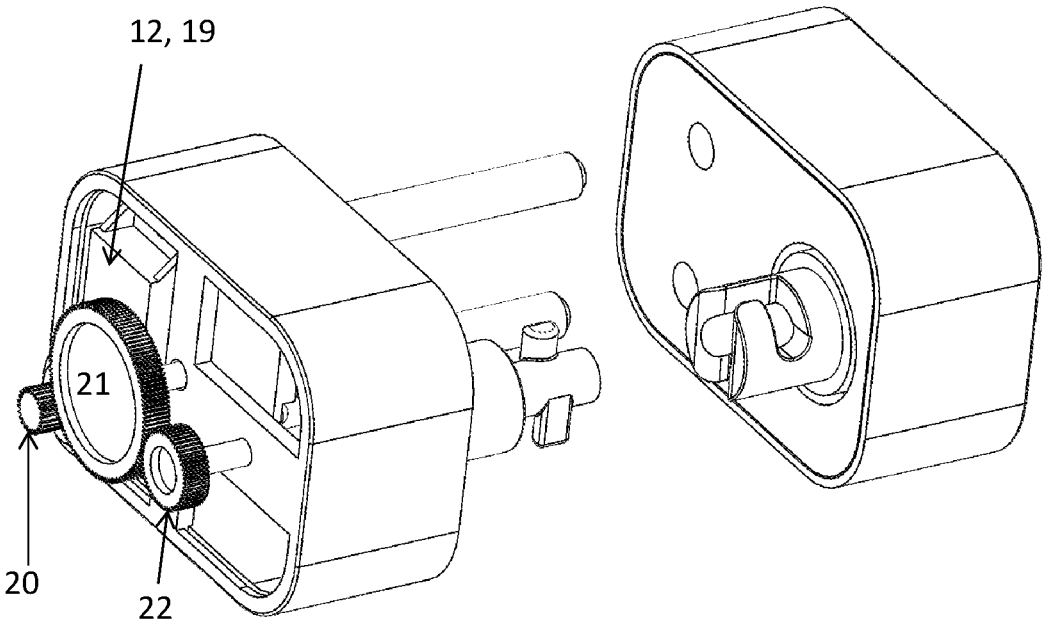
FIG. 2 shows an embodiment of the switching means inside the Gun Lock.

The gun lock comprises switching means 12 positioned inside one of the armored parts for switching between the locked and unlocked state. In one embodiment, shown in FIG. 2 the switching means 12 comprises an electrical motor 18 and a gear 19 transferring movement of the motor to a rotational movement of the first or second locking formation. The gear 19 may comprise a drive cogwheel 20 connected to the motor 18, a transfer cogwheel 21 transferring the torque to a locking beam cogwheel 22 which is turning the locking beam 4.

Figure 3:
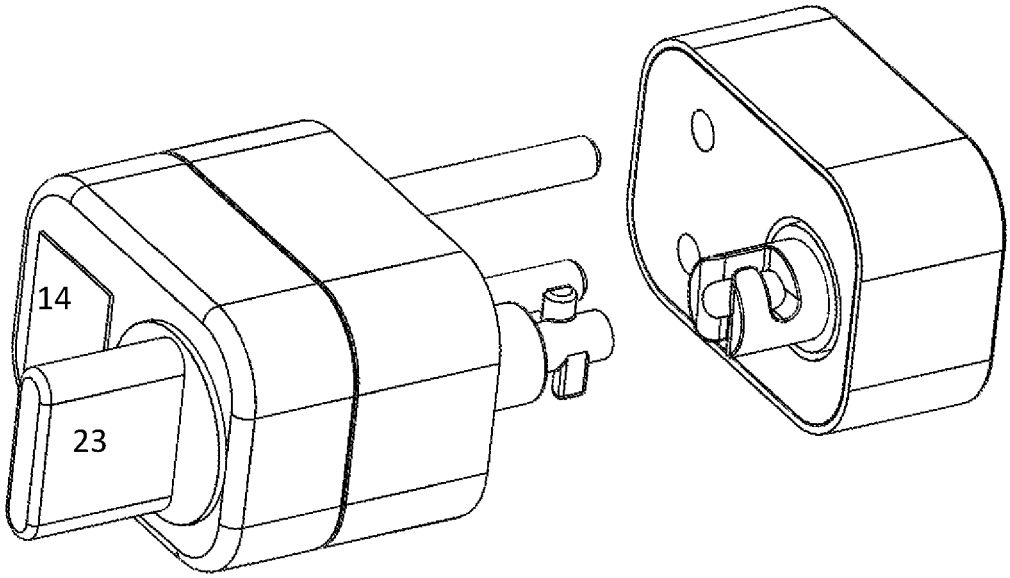
FIG. 3 shows an embodiment with a manual hand grip.
Figure 4:
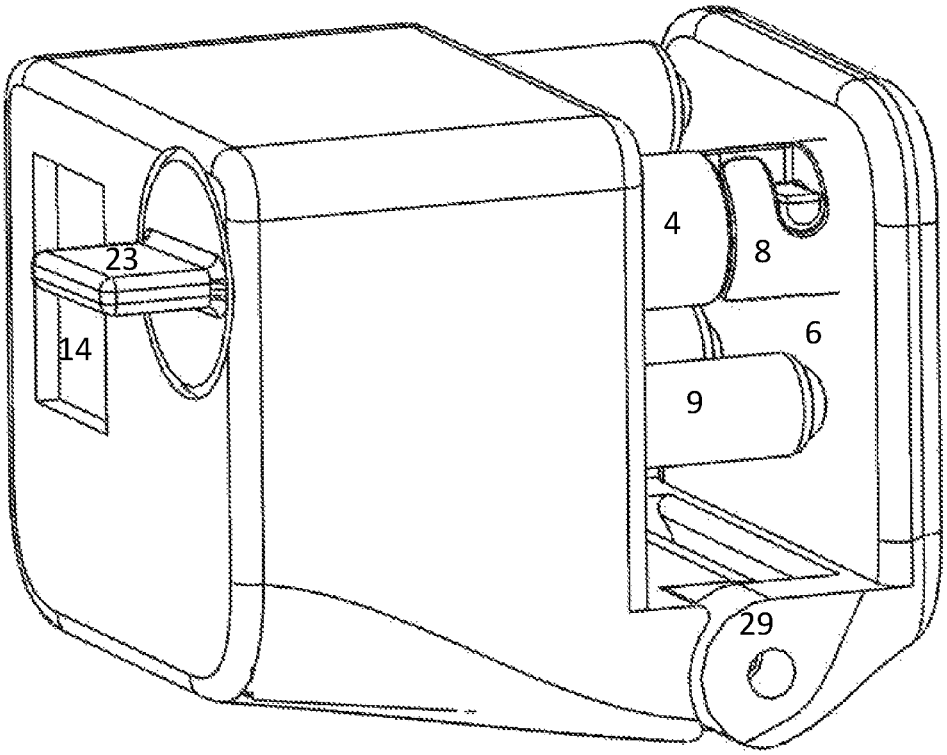
FIG. 4 shows an embodiment with the two armored parts hinged together.

In another embodiment, shown in FIGS. 3 and 4 the switching means is activated by a manually operated grip 23 for switching the switching means between the unlocked and the locked state, and wherein the switching means further comprises blocking means 28 for blocking the switching means 12 from switching from locked to unlocked. An advantage in using blocking means and a manually operated grip is that it requires less energy and the batteries will last longer. The blocking means could be a ratchet system around the locking beam switching between the locked and unlocked state by means of a solenoid.

Figure 5:
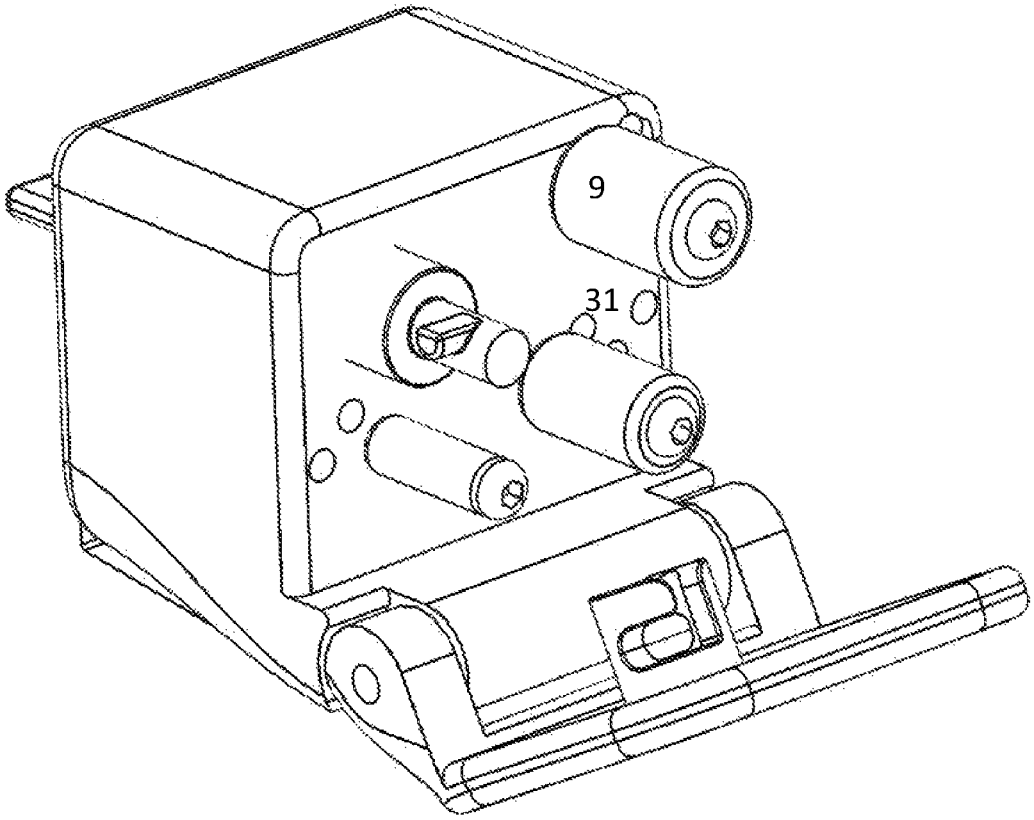
FIG. 5 shows multiple mounting locations for support beams.
Figure 6:
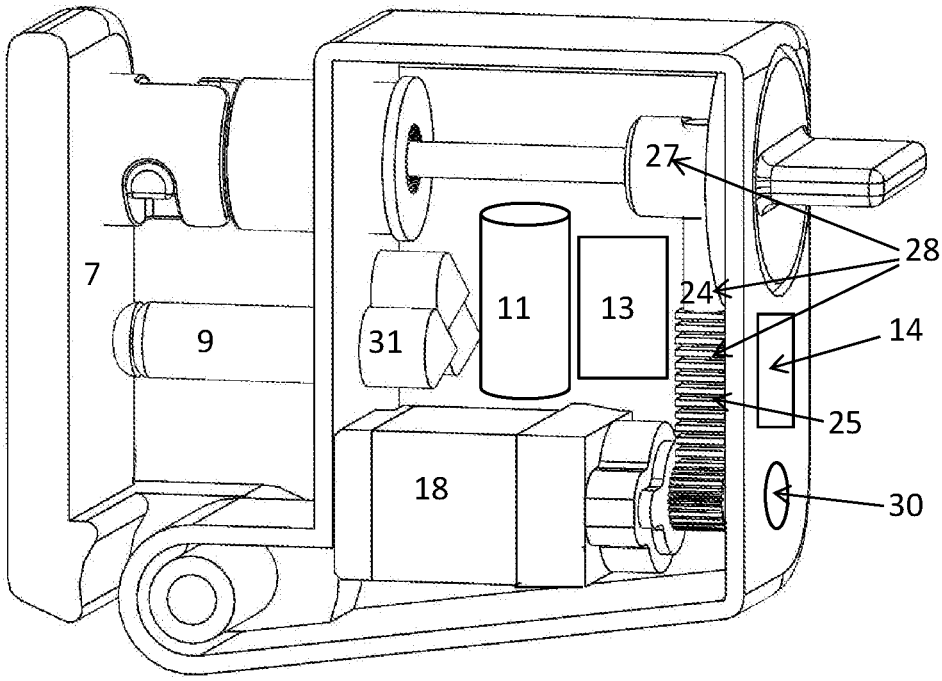
FIG. 6 shows an embodiment with blocking means in a locked state.
Figure 7:
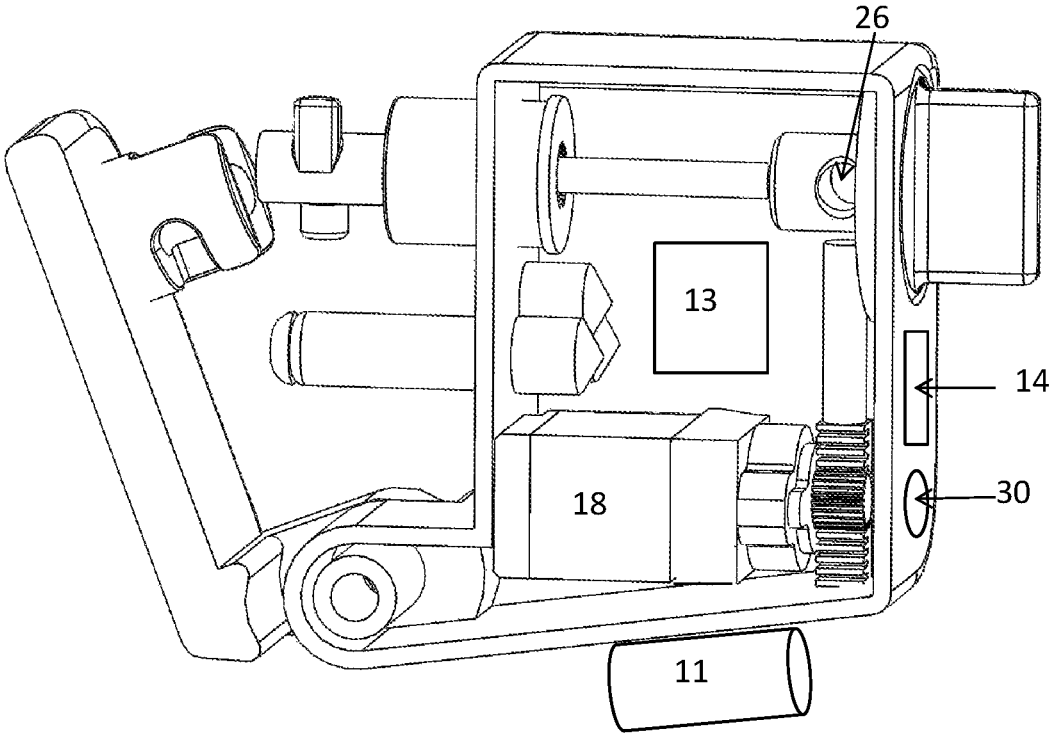
FIG. 7 shows an embodiment with blocking means in an unlocked state.

In a preferred embodiment, shown in FIG. 5, the blocking means comprises a rod 24 with a pitch rack 25 as seen in FIGS. 6 and 7. The rod mates with a blocking hole 26 in a blocking cylinder 27 connected to the locking beam 4 and hand grip 23 and are rotable around the same axis as the locking beam.

The gun lock further comprises a biometric sensor 14 for deciding whether or not to allow use of switching means and unlocking of the gun lock. This decision is taken by a processor positioned inside one of the armored parts, based on data from the biometric sensor. If the processor finds that the observed biometric data matches a predetermined set of data related to an allowed user the gun lock is opened by the switching means or allowed to be opened by the blocking means. Preferably the biometric sensor is a fingerprint sensor. The biometric sensor could be positioned on the inside of one of the armored parts with a window for reading fingerprints. In another embodiment the biometric sensor is positioned on the outside of the armored part comprising the processor and sends unprocessed biometric data to the processor on the inside of the armored part. The important thing is that most of the processing takes place inside the armored part. This is to avoid an easily replaced signal like yes/no coming from the outside to release the gun lock.

In an embodiment without a manual grip the locking of the gun lock is for example done by pushing a button 30 to move the locking formations into a locked position. In an embodiment with a manual grip the locking of the gun lock is done by manually rotating the hand grip and then moving the blocking rod to a locked position by activating the motor 18 for example by pushing a button. Obviously both locking and unlocking can be done by using the biometric sensor. However it is an advantage being able to lock the gun lock without the owner being present.

For operating the processor, the sensor and possibly the switching means and blocking means a power source like a battery is needed. The battery can be positioned inside or outside the armored parts. It is most preferred with the battery on the outside as indicated in FIG. 7, because then it is easier to change the batteries if the batteries looses power when the gun lock is in the locked state.

In a preferred embodiment, shown in FIG. 5, at least one of the abutting surfaces 3, 7 has multiple mounting locations 31 for the at least one support beam(s) 9. This is for adapting the gun lock to fit a particular fire arm. The support beams may also be fitted with flexible outer layer for easy mounting without slack. Also the two abutting sides may have a flexible layer.

In one embodiment the two armored parts 2, 6 are separate units and the locking beam and the at least one support beam is configured to be positioned on either side of the trigger inside the trigger guard when in a locked state. In another embodiment each armored part is attached to the respective ends of two arms hinged together and configured to be wrapped around a part of the gun, like the barrel or hand grip (not shown). In a preferred embodiment the two armored parts are attached to each other by hinges 29 as shown in FIG. 4-7.

In one embodiment the gun lock is provided with a transmitter and a receiver for transmitting and receiving radio signals. This enables a central unit, for example a police headquarter, to keep track of the current status of each gun lock and remotely respond to a request by an officer for opening a gun lock if a situation should arise where availability of a gun is needed. The gun lock may also be provided with a positioning system. The positioning system can be based on satellites like GPS, GLONASS or KOMPASS or it can be based on triangulation between base stations in a mobile system. The position of a gun lock can then be transmitted to the central unit or headquarter by the transmitter.

INVENTORY

1. Gun Lock
2. First armored part
3. First abutting side
4. Locking beam
5. First locking formation
6. Second armored part
7. Second abutting side
8. Second locking formation
9. Support beam
10. Support hole
11. Power source
12. Switching means
13. Processor
14. Biometric sensor
15. Locking pin
16. Guiding track
17. Locking track
18. Electrical motor
19. Gear
20. Drive cogwheel
21. Transfer cogwheel
22. Locking beam cogwheel
23. Hand grip
24. Blocking rod
25. Pitch rack
26. Blocking hole
27. Blocking cylinder
28. Blocking means
29. Hinge
30. Locking button
31. Mounting locations for support beam

The invention claimed is:

1. A gun lock, for blocking a trigger inside a trigger guard of a gun, comprising:

a first armored part with a first abutting side from which a locking beam with a first locking formation is protruding, and a second armored part with a second abutting side comprising a second locking formation mating with the first locking formation, wherein the first and second locking formations are switchable between a locked state and an unlocked state, at least one support beam protruding from one of the first and second abutting sides and extending at least past the trigger towards the other of the first and second abutting sides, a power source, a switching means positioned inside one of the first and second armored parts for switching between the locked state and the unlocked state, a biometric sensor reading biometric data of a user, a processor positioned inside one of the first and second armored parts for processing the biometric data from the biometric sensor and allowing unlocking the gun lock if the biometric data match data from allowed users, and wherein the locking beam and the at least one support beam are configured to be positioned on either side of the trigger inside the trigger guard when in a locked state, wherein the first and second armored parts cover at least the trigger and the trigger guard, and, wherein the switching means is activated by a manually operated hand grip for switching the switching means between the unlocked state and the locked state and blocking means for blocking the switching means from switching from the locked state to the unlocked state.

2. The gun lock according to claim 1 wherein the first locking formation is at least one locking pin protruding at a right angle from a cylindrical outer part of the locking beam and the second locking formation is a pipe with a longitudinal guiding track mating with the at least one locking pin and a locking track at a right angle to the longitudinal guiding track, wherein a rotational movement of the first locking formation or the second locking formation will lock the first and second armored parts together.

3. The gun lock according to claim 1, wherein the switching means for switching between the locked state and the unlocked state comprises an electrical motor and a gear transferring movement of the motor to a rotational movement of the first locking formation or the second locking formation.

4. The gun lock according to claim 1 wherein the blocking means comprises a rod with a pitch rack, wherein the rod mates with a blocking hole in a blocking cylinder connected to the locking beam and the hand grip and is rotatable around a same axis as the locking beam.

5. The gun lock according to claim 1 wherein the switching means and the processor reside within the same armored part.

6. The gun lock according to claim 1 wherein the biometric sensor is positioned outside of the first armored part and the second armored part and the sensor sends unprocessed biometric data to the processor inside the first armored part and the second armored part.

7. The gun lock according to claim 1 wherein the first and second armored parts are attached to each other by a hinge.

8. The gun lock according to claim 1 wherein the biometric sensor is a fingerprint sensor.

9. The gun lock according to claim 1 wherein the at least one support beam protruding from one of the first and second abutting sides mates with corresponding support holes in the other first and second abutting side.

10. The gun lock according to claim 1 wherein a transmitter and receiver are attached to the gun lock.

* * * * *